US006454836B1

(12) United States Patent
Koelmel et al.

(10) Patent No.: US 6,454,836 B1
(45) Date of Patent: Sep. 24, 2002

(54) METHOD AND APPARATUS FOR WELLBORE GAS SEPARATION

(75) Inventors: Mark H. Koelmel, London (GB); Stephen Miller, San Francisco; Curtis L. Munson, Oakland, both of CA (US); David R. Underdown, Conroe; Rick A. Wright, Houston, both of TX (US); Jean P. Camy, Danville, CA (US); Steve E. Ross, Laguna Beach, CA (US); Peter C. Schmidt, Walnut Creek, CA (US)

(73) Assignee: Chevron U.S.A. Inc., San Ramon, CA (US)

( * ) Notice: Subject to any disclaimer, the term of this patent is extended or adjusted under 35 U.S.C. 154(b) by 0 days.

(21) Appl. No.: 09/721,156

(22) Filed: Nov. 21, 2000

Related U.S. Application Data

(63) Continuation of application No. PCT/US00/08121, filed on Mar. 27, 2000.
(60) Provisional application No. 60/126,616, filed on Mar. 27, 1999.

(51) Int. Cl.[7] ..... B01D 53/22; B01D 19/00
(52) U.S. Cl. ..... 95/46; 95/47; 95/49; 95/51; 95/52; 95/53; 96/6; 96/7; 96/9; 96/10; 96/14
(58) Field of Search ..... 95/45–49, 51–54; 96/4, 6–14

(56) References Cited

U.S. PATENT DOCUMENTS

| | | | | | |
|---|---|---|---|---|---|
| 4,171,017 | A | * | 10/1979 | Klass | 96/10 X |
| 4,482,364 | A | * | 11/1984 | Martin et al. | 96/6 |
| 4,685,940 | A | * | 8/1987 | Soffer et al. | 55/158 |
| 4,690,873 | A | * | 9/1987 | Makino et al. | 428/473.5 |
| 4,728,345 | A | * | 3/1988 | Murphy | 55/158 |
| 5,234,471 | A | * | 8/1993 | Weinberg | 95/47 |
| 5,288,304 | A | * | 2/1994 | Koros et al. | 95/45 |
| 5,693,230 | A | * | 12/1997 | Asher | 95/46 X |
| 5,830,261 | A | * | 11/1998 | Hamasaki et al. | 96/13 X |
| 6,228,146 | B1 | * | 5/2001 | Kuespert | 96/9 X |
| 6,299,669 | B1 | * | 10/2001 | Koros et al. | 95/51 |

* cited by examiner

*Primary Examiner*—Robert H. Spitzer
(74) *Attorney, Agent, or Firm*—Richard J. Schulte

(57) ABSTRACT

A downhole preferential hydrocarbon gas recovery system and method employ preferentially selective materials to separate the hydrocarbon gas from contaminants. According to one aspect of the invention, the preferentially selective materials are arranged in tubes with the hydrocarbon gas flowing through the tubes and the contaminants permeating out through the preferentially selective material.

32 Claims, 4 Drawing Sheets

METHOD AND APPARATUS FOR WELLBORE GAS SEPARATION

CROSS-REFERENCE TO RELATED APPLICATIONS

This application is a Continuation of PCT/US00/08121 filed on Mar. 27, 2000, which is a continuation of U.S. Provisional Application No. 60/126,616 filed on Mar. 27, 1999.

FIELD OF THE INVENTION

The invention relates to recovery of hydrocarbon gas from a wellbore, and more particularly, the invention relates to technology for separation of contaminants from hydrocarbon gas in a wellbore and selective recovery of hydrocarbon gas.

BACKGROUND OF THE INVENTION AND BRIEF DESCRIPTION OF THE RELATED ART

Hydrocarbon gases and liquids have been recovered from underground wellbores for over a hundred years. The recovery technology generally involves drilling a wellbore into a hydrocarbon gas or liquid formation and withdrawing the materials under reservoir pressure or by artificial lifting.

In hydrocarbon gas wells, the current recovery technology involves removing the hydrocarbon gas and any contaminants which are present from the wellbore together, and separating the contaminants from the hydrocarbon gas above ground. This above ground separation is costly. Disposal of the removed contaminants may also present environmental problems. The contaminants which may be produced include gases, such as carbon dioxide, nitrogen, water vapor, hydrogen sulfide, helium, and other trace gases, and liquids such as water, heavy hydrocarbons, and others.

The contaminants which are brought to the surface and separated from the hydrocarbon gas must be released to the atmosphere or otherwise disposed of adding additional expense to the process. Due to environmental concerns about the release of greenhouse gases, many countries are placing greater and greater limitations on emission of byproduct gases to the atmosphere. For example, some countries now access a tax on carbon dioxide emissions. Other gases are highly corrosive or poisonous and require special handling. For example, hydrogen sulfide must be reacted and converted to molten sulfur before disposal.

Accordingly, it would be highly desirable to maintain some or all of the contaminant materials within the wellbore and/or selectively separate these gases in the wellbore for reinjection, removal, or other processing.

Membrane technologies have been developed which allow the selective passage of materials. However, this technology has heretofore been used as a surface technology for separating hydrocarbons from contaminants after recovery and has not been used in a downhole situation. Accordingly, it would be desirable to provide an apparatus and method for downhole separation and selective recovery to maximize the production of a desired hydrocarbon gas while minimizing production or separately producing contaminants.

SUMMARY OF THE INVENTION

The present invention relates to a downhole preferential recovery technology for separation of contaminates such as carbon dioxide, nitrogen, water vapor, hydrogen sulfide, helium, trace gases, water, heavy hydrocarbons, and other contaminates from hydrocarbon gases.

In accordance with one aspect of the present invention, a method of separating gases in a wellbore includes the steps of: placing a wellbore within a production zone; removing a hydrocarbon gas from the wellbore; and removing at least one contaminant from the hydrocarbon gas with a system including a first preferentially selective material positioned in the wellbore and a second preferentially selective material positioned in the wellbore, wherein the first preferentially selective material is permeable to different materials than the second preferentially selective material.

In accordance with an additional aspect of the present invention, a system for separating gases in a wellbore includes a first preferentially selective material configured to be positioned in the wellbore and a second preferentially selective material configured to be positioned in the wellbore. The first preferentially selective material separates a first contaminant from a hydrocarbon gas and the second preferentially selective material separates a second contaminant from the hydrocarbon gas.

The present invention provides advantages of a safe and economical solution to the separation of gases within a wellbore.

BRIEF DESCRIPTION OF THE DRAWINGS

The invention will now be described in greater detail with reference to the preferred embodiments illustrated in the accompanying drawings, in which like elements bear like reference numerals, and wherein.

DETAILED DESCRIPTION OF THE PREFERRED EMBODIMENTS

The method and system according to the present invention use preferentially selective materials for downhole separation of contaminates from hydrocarbon gas. The use of more than one type of preferentially selective material allows multiple contaminants to be removed prior to or during recovery of the hydrocarbon gas to the surface.

For purposes of this application, contaminants are defined as any undesirable material found in the wellbore with the hydrocarbon gas.

Preferentially selective materials are defined as materials which are permeable to a first fluid and are substantially impermeable to a second fluid.

Some of the contaminants which may be removed are gases including carbon dioxide, nitrogen, water vapor, hydrogen sulfide, helium, and other trace gases, and liquids including water, heavy hydrocarbons, and other liquids. The hydrocarbon gas from which the contaminants are separated according to the present invention may be methane, ethane, propane, or others.

Figure 1:
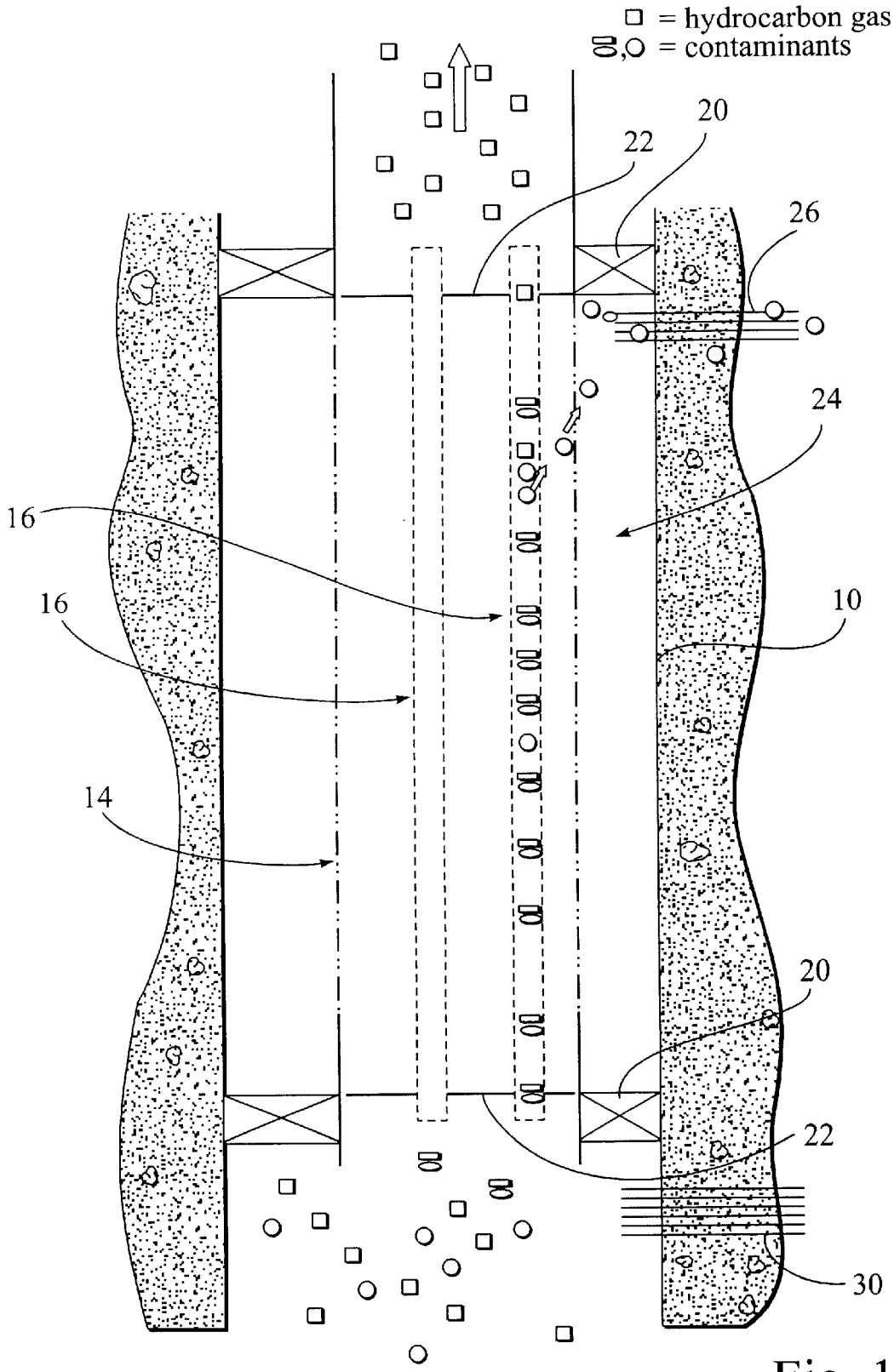
FIG. 1 is a schematic side cross sectional view of a first downhole apparatus for separating contaminants according to the present invention.

FIG. 1 illustrates a first embodiment of a gas separation system positioned in a wellbore 10 for subsurface separation. The separation system includes an outer perforated shell 14 surrounding one or more inner tubes 16 which contain a preferentially selective material. A pair of packings 20 is provided around the shell 14 and a second pair of packings 22 is provided around the inner tubes 16 to isolate a contaminant collection zone 24.

In operation, the hydrocarbon gas and contaminants enter the wellbore below the containment collection zone 24 through production perforations 30. The hydrocarbon gas and contaminants pass upward through the inner tubes 16. As the hydrocarbon gas passes through the inner tubes 16, one or more contaminants permeate out of the inner tubes through the preferentially selective material and enter the containment collection zone 24. The hydrocarbon gas plus any remaining contaminants which were not removed continue out the tops of the tubes 16. The hydrocarbon gas with reduced contaminants is passed to the surface or to another separation system. The contaminants which have been collected in the collection zone 24 may be disposed of by directing the contaminants through the perforations 26 to an underground disposal formation. Alternatively, an additional tube may be provided for removal of the contaminants from the collection zone 24 to the surface.

Figure 2:
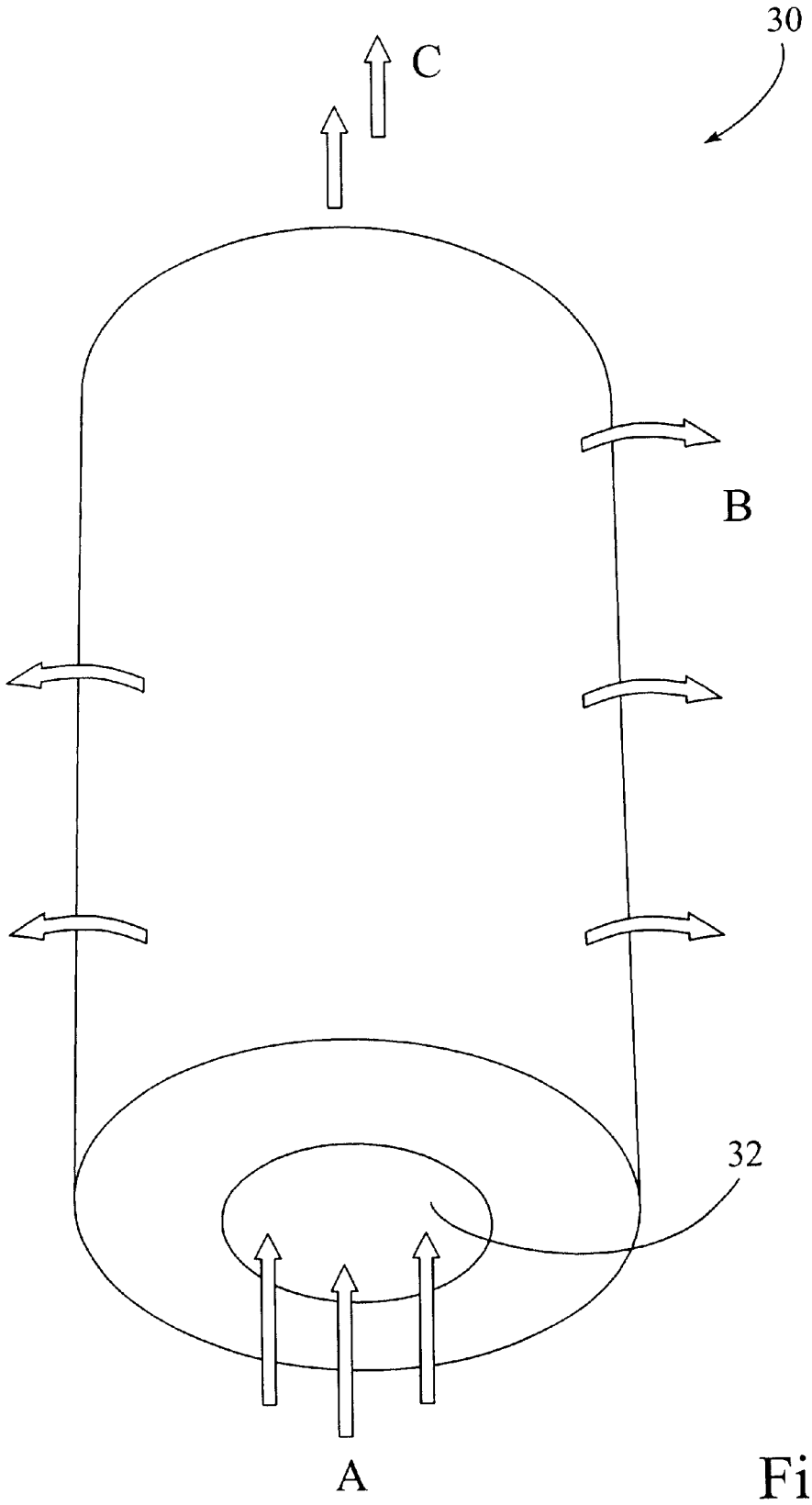
FIG. 2 is a perspective view of a preferentially selective material cartridge for use in the apparatus of FIG. 1.

FIG. 2 illustrates one example of a membrane cartridge or element 30 formed of a preferentially selective material for permeating contaminants. The membrane element 30 is a tubular element having a central bore 32 through which the hydrocarbon gas and contaminants pass in the direction indicated by the arrows A. The contaminants permeate out through the preferentially selective material as indicated by the arrows B, while the hydrocarbon gas continues out the top of the membrane element as indicated by the arrows C. The membrane elements 30 may be stacked within a perforated tube to form the inner tubes 16 or may be interconnected to form a self supporting tube 16.

Each one of the stacked membrane elements 30 may be designed to permeate one or more of the contaminants which are present in the well. For example, one membrane element 30 may be designed for removal of carbon dioxide, a second for removal of hydrogen sulfide, and a third for removal of heavy hydrocarbons.

Although a hollow fiber or tubular shaped membrane formed of multiple membrane elements 30 is illustrated, other membrane shapes may also be used. Some other membrane shapes include spiral wound, pleated, flat sheet, or polygonal tubes. The use of multiple hollow fiber membrane tubes have been selected for their large fluid contact area. The contact area may be further increased by adding additional tubes or tube contours. Contact may also be increase by altering the hydrocarbon flow by increasing fluid turbulence or swirling.

The membrane elements 30 may be stacked in different arrangements to remove contaminants from the flow of hydrocarbon gas in different orders. For example, the bottom membrane elements 30 may be those that remove water and heavy hydrocarbons which may damage some of the gas removal membrane materials. The top membrane elements 30 may be those that remove carbon dioxide and hydrogen sulfide.

The different contaminants may be removed into a single contaminant collection zone 24 and disposed of together by removal or reinjection. Alternatively, the different contaminants may be maintained in different zones for removal and/or reinjection separately. The membrane elements 30 may be arranged in series or parallel configurations or in combinations thereof depending on the particular application.

The membrane elements 30 may be removable and replaceable by conventional retrieval technology such as wire line, coil tubing, or pumping. In addition to replacement, the membrane elements may be cleaned in place by pumping gas, liquid, detergent, or other material past the membrane to remove materials accumulated on the membrane surface.

The gas separation system according to the present invention may be of a variable length depending on the particular application. The stacked membrane elements 30 may even extend along the entire height of the wellbore for maximum contaminant removal.

FIGS. 1 and 2 illustrate an inside-out flow path where the hydrocarbon gas and contaminants flow into the inside of the tube(s) 16 of preferentially selective material and the contaminant permeates out through the tube 16. However, an outside-in flow path may also be used where the hydrocarbon gas and contaminants flow around the outside of the tube(s) and the contaminants are permeated into the inner bore of the tube(s).

Figure 3:
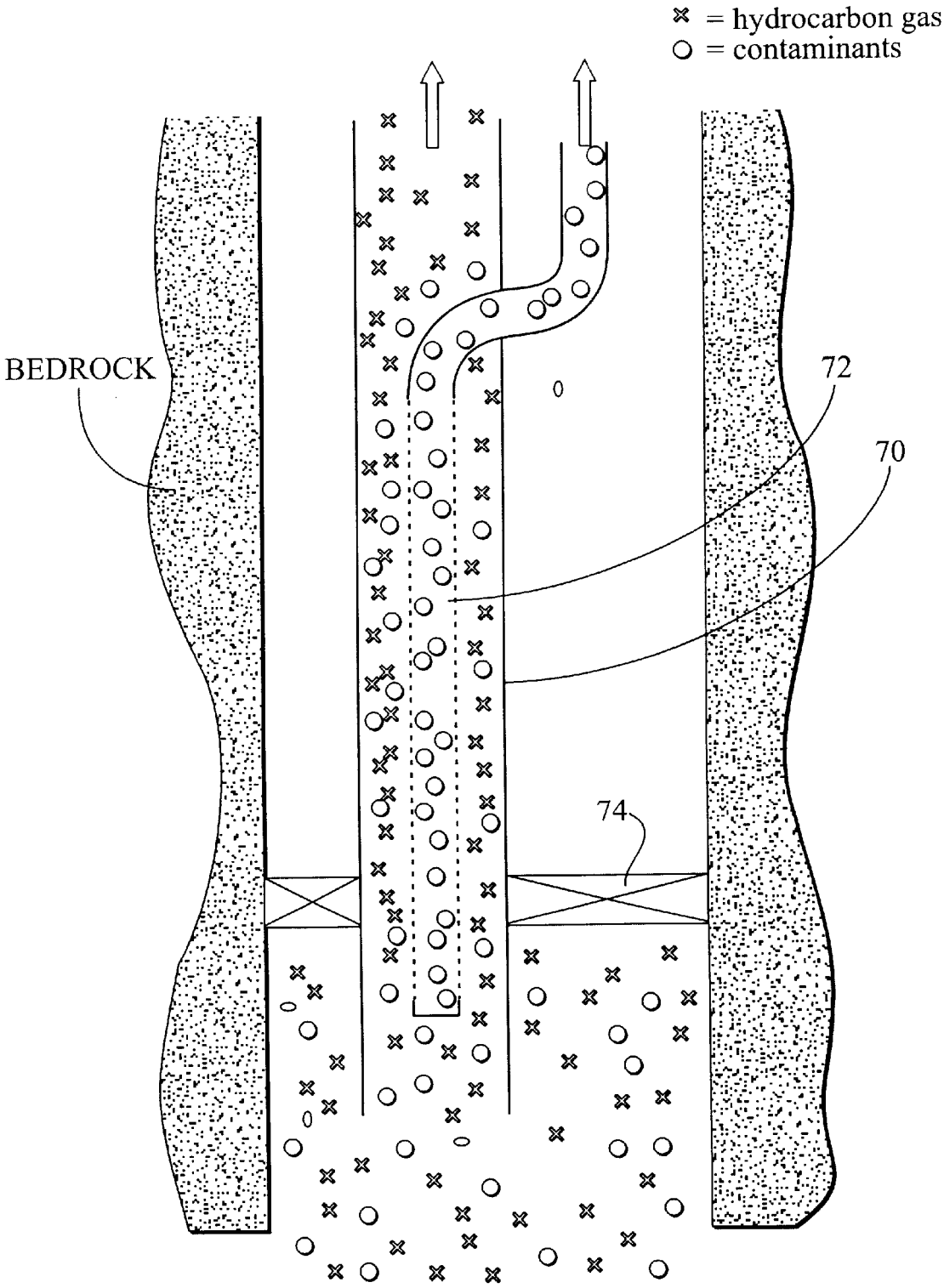
FIG. 3 is a schematic side cross sectional view of a second downhole apparatus for separating contaminants according to the present invention.

FIG. 3 illustrates a separation system having an outside-in flow path.

As shown in FIG. 3, the gas separation system includes an outer tube 70 and an inner tube 72 of a preferentially selective material. The outer and inner tubes 70, 72 are positioned within the wellbore. A packing 74 isolates the well gases below the separation system.

In operation, the hydrocarbon gas and contaminants pass up through the outer tube 70. While the hydrocarbon gas passes through the outer tube 70, the contaminants are removed from the hydrocarbon gas by permeating through the preferentially selective material into a center of the inner tube 72. The removed contaminants may be reinjected in a disposal formation or removed from the well separately from the hydrocarbon gas. As in the embodiment of FIG. 1, the inner tube 72 may be one or more tubes formed of one or more membrane cartridges. One and preferably two or more preferentially selective material are used to remove different contaminants.

In order to prevent or reduce possibly damaging contact between liquid or particulate contaminates and the preferentially selective material, the flowing gas may be caused to rotate or swirl within the outer tube 70. This rotation may be achieved in any known manner such as by one or more spiral deflectors.

Figure 4:
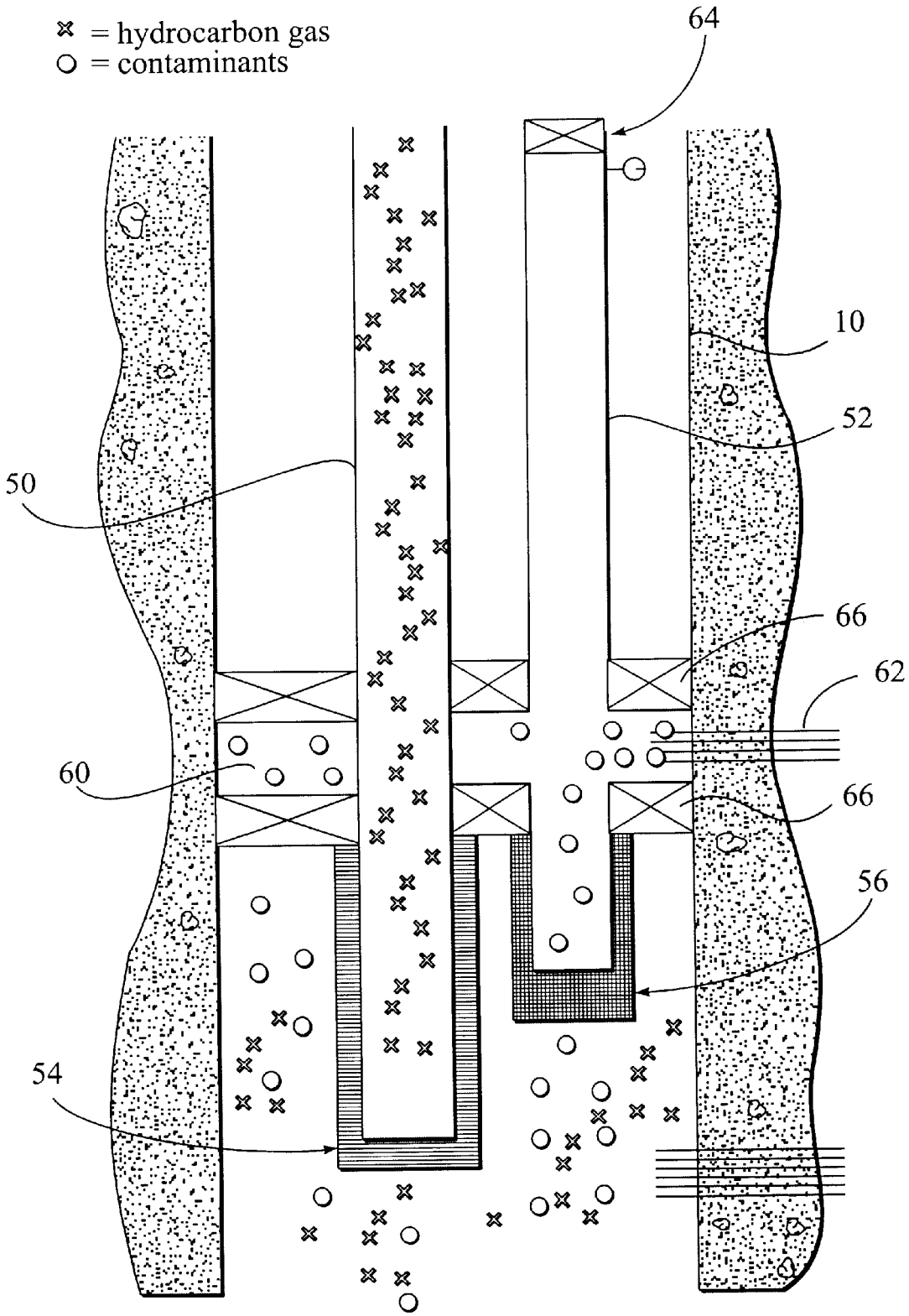
FIG. 4 is a schematic side cross sectional view of a third downhole apparatus for separating contaminants according to the present invention.

FIG. 4 illustrates an alternative embodiment of a contaminant removal system positioned in a wellbore 10. The separation system of FIG. 4 includes a hydrocarbon recovery tube 50 and a contaminant removal tube 52. A preferentially selective material membrane 54 in the form of a cap is positioned on the bottom of the hydrocarbon recovery tube 50. The membrane 54 allows the hydrocarbon gas to pass through the membrane material and prevents one or more contaminants from passing into the hydrocarbon removal tube 50. A second preferentially selective material membrane 56 in the form of a cap is positioned on the bottom of the contaminant removal tube 52 for removal of one or more contaminants from the wellbore. The membrane material 56 allows the passage of one or more contaminants while preventing the passage of the hydrocarbon gas.

According to the embodiment of FIG. 4, the removed contaminant material is collected in a contaminant collection zone 60 which may be provided with perforations 62 for reinjecting the contaminant into a disposal formation. A vent 64 may also be provided for removing and/or sampling the collected contaminant. Packers 66 are provided to isolate the fluid in the contaminant collection zone 60 from the remainder of the wellbore. As in the previous embodiments, the embodiment of FIG. 4 provides a down hole system for separating hydrocarbon gas from contaminants which employs two or more different preferentially selective materials. It should be understood that several different contaminant collection tubes 52 and contaminant removal membranes 56 for removal of the same or different contaminants may be provided depending on the particular application. Further, the tubes according to this embodiment can be arranged concentrically for space savings.

The preferentially selective materials according to the present invention are selected to be durable, resistant to high temperatures, and resistant to exposure to liquids. The materials may be coated to help prevent fouling and improve durability. Examples of suitable membrane materials for removal of contaminants from a hydrocarbon gas stream include cellulose acetate, polysulfones, polyimides, cellulose triacetate (CTA), carbon molecular sieve membranes, ceramic and other inorganic membranes, composites comprising any of the above membrane materials with another polymer, composite polymer and molecular sieve membranes including polymer zeolite composite membranes, polytrimethylsilane (PTMSP), and rubbery polymers.

Preferred membrane materials include polyimides, carbon molecular sieve membranes, and composite polymer and molecular sieve membranes.

Especially preferred polyimides are the asymmetric aromatic polyimides in hollow fiber or flat sheet form. Patents describing these include U.S. Pat. Nos. 5,234,471 and 4,690,873.

Especially preferred carbon molecular sieve membranes are those prepared from the pyrolysis of asymmetric aromatic polyimide or cellulose hollow fibers. Patents describing these include European Patent Application 0 459 623 and U.S. Pat. No. 4,685,940. These fibers may be coated with a separate polymer or post-treated after spinning to increase resistance to high humidity and impurities, such as in U.S. Pat. Nos. 5,288,304 and 4,728,345.

Membranes which are preferred for removal of heavy hydrocarbons include PTMSP and rubbery polymers.

The number, type, and configuration of the preferentially selective material may vary depending on the particular well. Preferably, the separation system is specifically designed for a particular well taking into account the type and amounts of hydrocarbon gas and contaminants present the well, and the well configuration.

According to another embodiment the cap type membranes shown in FIG. 4 may be combined with the tube type membranes of FIG. 1. For example, a cap membrane permeating heavy hydrocarbons may be combined with a tube type membrane permeating carbon dioxide.

The present invention may be combined with existing downhole technologies for mechanical physical separation systems, such as cyclones. Barrier materials may also be used as a prefilter for removal of particulates and other contaminants which may damage the preferentially selective material. The invention may also be used for partial removal of the contaminants to reduce the burden on surface removal facilities with the remaining contaminants removed by conventional surface technologies. Some types of separated contaminants such as carbon dioxide can be reinjected into the wellbore to maintain pressurization of the formation.

Although the illustrated embodiments show vertical wells, it should be understood that the invention may also be used in horizontal wells or multi lateral wells.

Although the separation system of the present invention has been illustrated as located underground, the system may also be positioned on the ocean floor on a sub sea shelf or as early as feasible below the ground or ocean surface.

While the invention has been described in detail with reference to the preferred embodiments thereof, it will be apparent to one skilled in the art that various changes and modifications can be made and equivalents employed, without departing from the present invention.

What is claimed is:

1. A method of separating gases in a wellbore, the method comprising:

placing a wellbore within a production zone;

removing a hydrocarbon gas from the wellbore; and removing at least one contaminant from the hydrocarbon gas with a system including a first preferentially selective material positioned in the wellbore and a second preferentially selective material positioned in the wellbore, wherein the first preferentially selective material is permeable to different materials than the second preferentially selective material.

2. The method of claim 1, wherein the hydrocarbon gas passes through passageways formed in the first and second preferentially selective materials.

3. The method of claim 2, wherein the at least one contaminant is permeated into a space surrounding the first and second preferentially selective materials.

4. The method of claim 2, wherein the passageways are a plurality of tubes formed of the preferentially selective material and the contaminant is permeated into a space surrounding the plurality of tubes.

5. The method of claim 1, wherein the first and second preferentially selective materials are arranged in series.

6. The method of claim 1, wherein the first and second preferentially selective materials are arranged in parallel.

7. The method of claim 1, wherein the at least one contaminant is removed from the hydrocarbon gas and is reinjecting into a disposal formation beneath the surface.

8. The method of claim 1, wherein the at least one contaminant is removed from the hydrocarbon gas and is separately recovered.

9. The method of claim 1, wherein the at least one contaminant is a gas selected from the group consisting of carbon dioxide, nitrogen, water vapor, hydrogen sulfide, and helium.

10. The method of claim 1, wherein the at least one contaminant is a liquid selected from the group consisting of water and heavy hydrocarbons.

11. The method of claim 1, wherein the first and second preferentially selective materials remove a first and a second contaminant, respectively.

12. The method of claim 11, further comprising removing a third contaminant from the hydrocarbon gas with a third preferentially selective material positioned in the wellbore.

13. The method of claim 1, further comprising a step of removing and replacing the first and second preferentially selective materials.

14. The method of claim 1, further comprising a step of cleaning the first and second preferentially selective materials in the wellbore.

15. The method of claim 1, wherein the hydrocarbon gas is permeated through the first preferentially selective material and the contaminant is permeated through the second preferentially selective material.

16. A system for separating gases in a wellbore, the system comprising:

a first preferentially selective material configured to be positioned in the wellbore, the first preferentially selective material separating a first contaminant from a hydrocarbon gas; and a second preferentially selective material configured to be positioned in the wellbore, the second preferentially selective material separating a second contaminant from the hydrocarbon gas.

17. The system of claim 16, wherein the first and second preferentially selective materials are formed with central passageways.

18. The system of claim 16, further comprising a reservoir for receiving the contaminants and delivering the contaminants to a disposal formation in the ground.

19. The system of claim 16, wherein the first and second preferentially selective materials are arranged in series.

20. The system of claim 16, wherein the first and second preferentially selective materials are arranged in parallel.

21. The system of claim 16, further comprising a third preferentially selective material positioned in the wellbore for removing a third contaminant from the hydrocarbon gas.

22. The system of claim 16, wherein one of the first and second preferentially selective materials is an inversely selective membrane material.

23. The system of claim 16, further comprising a production tube receiving the hydrocarbon gas which has passed through a passageway in the first and second preferentially selective materials and delivering the hydrocarbon gas to the surface.

24. The system of claim 16, wherein the first and second preferentially selective materials are arranged in a plurality of tubes.

25. The system of claim 24, wherein the tubes are arranged such that the hydrocarbon gas passes through a central passageway of the tubes while the first and second contaminants permeate outwards through the tubes.

26. The system of claim 24, wherein the tubes are arranged such that the hydrocarbon gas passes around the tubes and the contaminants permeate into a central passageway of the tubes.

27. The system of claim 16, wherein the first and second preferentially selective materials are selected from the group consisting of a membrane of cellulose acetate, polysulfone, polyimide, polymers, cellulose triacetate, mixed matrix composite, carbon molecular sieve membranes, ceramic, composite polymer, polytrimethylsilane, and rubber.

28. The system of claim 16, wherein the first preferentially selective material is a polymer zeolite composite membrane.

29. A system for separating gases in a wellbore, the system comprising:

at least one tube of preferentially selective material configured to be positioned in the wellbore for removing a first contaminant from a hydrocarbon gas passing through the tube; and a contaminant collection zone surrounding the at least one tube and isolated from the hydrocarbon gas for collecting the removed contaminant.

30. The system of claim 29, wherein the at least one tube includes a plurality of preferentially selective materials for removal of a plurality of contaminants.

31. The system of claim 29, wherein the contaminant collection zone includes perforations for delivering the contaminant to a disposal formation in the ground.

32. The system of claim 29, further comprising a contaminant removal tube for delivering the contaminant from the contaminant collection zone to the surface.

* * * * *